US005756273A

United States Patent [19]

Wang et al.

[11] Patent Number: 5,756,273

[45] Date of Patent: May 26, 1998

[54] PHOTOGRAPHIC ELEMENT CONTAINING A CORE/SHELL POLYMER LATEX

[75] Inventors: Yongcai Wang, Penfield; Gary William Visconte, Rochester; Alfred Bruce Fant, Rochester; James Lee Bello, Rochester; Kurt Michael Schroeder, Rochester, all of N.Y.

[73] Assignee: Eastman Kodak Company, Rochester, N.Y.

[21] Appl. No.: 595,891

[22] Filed: Feb. 6, 1996

[51] Int. Cl.[6] ..... G03C 1/76

[52] U.S. Cl. ..... 430/537; 430/523; 430/531; 430/533; 430/534; 430/535; 430/536; 430/627; 430/961

[58] Field of Search ..... 430/537, 523, 430/531, 533, 534, 535, 536, 627, 961

[56] References Cited

U.S. PATENT DOCUMENTS

| | | | |
|---|---|---|---|
| H1016 | 1/1992 | Hatakeyama et al. | 430/533 |
| 3,287,289 | 11/1966 | Ream et al. | 260/8 |
| 4,497,917 | 2/1985 | Upson et al. | 523/201 |
| 4,714,671 | 12/1987 | Helling et al. | 430/545 |
| 4,977,071 | 12/1990 | Kanetake et al. | 430/533 |
| 5,286,597 | 2/1994 | Suzuki et al. | 430/262 |
| 5,561,034 | 10/1996 | Desie et al. | 430/536 |

*Primary Examiner*—Geraldine Letscher
*Attorney, Agent, or Firm*—Carl F. Ruoff; Robert A. Gerlach

[57] ABSTRACT

A photographic element having a support, a light-sensitive layer and a protective overcoat layer, at least one layer comprising a hydrophilic colloid containing colloidal core-shell latex particles, the core being a hydrophobic polymer and the shell comprising greater than 10 and less than 90 mole percent of an ethylenically unsaturated monomer having a carboxylic acid group.

12 Claims, No Drawings

PHOTOGRAPHIC ELEMENT CONTAINING A CORE/SHELL POLYMER LATEX

FIELD OF THE INVENTION

This invention relates to photographic elements including a core/shell polymer latex that does not coagulate when contained in a coating solution and does not generate spot defects harmful to the physical performance of the photographic element.

BACKGROUND OF THE INVENTION

It is known to use synthetic polymer particles in a silver halide photographic element to improve physical characteristics. In particular, water-insoluble polymer dispersed in the form of very small particles and obtained by emulsion polymerization techniques (polymer latex particles) have found wide use as particle replacements for gelatin. For example, it has been proposed to use polymer latex particles in both the hydrophilic light-sensitive layers and hydrophilic light-insensitive layers to improve the element dimensional stability, to improve the element drying characteristics during photographic processing, to improve layer adhesion and flexibility, to reduce pressure fog, to control dye and image stability, to carry photographic useful compounds such as dyes, couplers, accelerators, hardeners, etc., and to improve the scratch and abrasion resistance of the layer, in particular the surface protective layer.

It is also known to include in the photographic element various addenda, such as salts, sensitizing dyes, surfactants, thickeners, inorganic fillers, organic solvents, couplers, etc. The presence of these various compounds in a coating solution significantly reduce the stability of polymer latex particles, for example, by reducing the electrostatic repulsion force from the interaction between electrical double layers or surface charges on the particles. Surfactants or sensitizing dyes may carry opposite charges to those on the polymer latex particle surface leading to latex particle flocculation through charge neutralization. This and other types of latex polymer particle instability and flocculation, and eventually coagulation can have a significant effect on manufacturing processes such as filtering and delivering of the coating solutions. The efficiency of the coating process is thereby reduced. Further, photographic characteristics are damaged leading to, for example, desensitization of the silver halide emulsion, dye stain after development, spot defects and displaced developed grains. In particular in the case of X-ray medical films, such defects impose risk of misdiagnosis in the case of reading radiographic materials.

Various methods have been proposed to improve the stability of polymer latex particles, for example, by post-addition of extra surfactants to the coating solution, by using surfactant mixtures, or by using polymer latex particles prepared by emulsion polymerization in the presence of a water-soluble high molecular weight material. However, adding extra surfactant can result in a significant increase in foaming of the coating solution. The presence of extra surfactant can also displace, for example, sensitizing dyes from the silver halide crystal surface and therefore affect photographic sensitometry. Still, the extra surfactants used to stabilize the latex may diffuse to the surface of the photographic materials causing undesirable surface charging properties. The use of high molecular weight water-soluble polymers, although useful for improving latex particle stability, can cause problems, such as, coating solution viscosity increase, deterioration of scratch resistance and ferrotyping protection.

Another source of instability comes from the level of hydrodynamic stress and mechanical energy applied to the coating solution. The failure of a coating solution containing a polymer latex occurs during coating processes, where high shear forces are generated by forcing the coating solution through mechanical pumps, ultrafine filters, narrow orifices, mechanical degassing systems, coating hoppers, etc. The failure of a solution is manifest in the deposition of debris as sticky or gritty particles which ultimately can cause filter blockage, thereby reducing the efficiency of the coating process. The generated coagulum can also form spot defects in the final coating, which may displace the developed grains. These spot defects produce low density spots in a high density portion of the picture and therefore cause deterioration of image quality. If the spot defects appear in the surface protective layer, it may lead to unacceptable surface haze.

It has been heretofore known to employ latex polymer particles in photographic elements that contain monomers having a carboxylic acid group. U.S. Pat. No. 3,287,289 describes a copolymer of at least one acid selected from acrylic acid or methacrylic acid, and at least one ester selected from acrylate, tertiary butyl acrylate, amyl acrylate, or hexyl acrylate. Improvement is made on plasticization of gelatin.

It is also known to use core/shell latex polymer particles in photographic element. U.S. Pat. No. 4,714,671 describes dispersed polymeric particles consisting of a soft core and a hard shell as plasticizer for gelatin in photographic recording materials.

PROBLEM TO BE SOLVED BY INVENTION

Therefore an object of the present invention is to provide improved polymer latex particles having excellent stability with respect to the manufacturing process of photographic materials, Another object is to provide photographic elements that do not cause additional haze or generate spot defects harmful to photographic performance of the element. Furthermore, there is a need for photographic elements having excellent physical properties such as scratch resistance and ferrotyping protection.

SUMMARY OF THE INVENTION

The invention provides a photographic element having a support, a light-sensitive layer and a protective overcoat layer, at least one layer comprising a hydrophilic colloid containing colloidal core-shell latex particles, the core being a hydrophobic polymer and the shell comprising greater than 10 and less than 90 mole percent of an ethylenically unsaturated monomer having a carboxylic acid group.

DESCRIPTION OF PREFERRED EMBODIMENTS

Photographic elements according to this invention can differ widely in structure and composition. For example, they can vary greatly in regard to the type of the support, the number and composition of the imaging forming layers, and the kinds of auxiliary layers that are included in the elements. Typical supports include cellulose nitrate film, cellulose acetate film, poly(vinyl acetal) film, polystyrene film, poly(ethylene terephthalate) film, poly(ethylene naphthalate) film, polycarbonate film, paper, synthetic paper and the like. The thickness of the support is not critical. Support thickness of 50 to 260 μm (2 to 10 mils) can be used. The support typically employs an undercoat or subbing layer well known in the art that comprises, for example, for polyester support a vinylidene chloride/methyl acrylate/itaconic acid terpolymer or vinylidene chloride/acrylonitrile/acrylic acid terpolymer.

The hydrophilic layer of the invention comprises a hydrophilic binder and polymer latex particles. The polymer latex particles comprise a hydrophobic core and a hydrophilic polymeric shell comprising greater than 10 mole percent and less than 90 mole percent of monomers having a carboxylic acid group, more preferably greater than 10 mole percent and less than 70 mole percent of monomers having a carboxylic group, and most preferably greater than 10 mole percent and less than 50 mole percent of monomers having a carboxylic group. The weight ratio of the core portion to shell portion is from 95:5 to 30:70, more preferably from 90:10 to 50:50, and most preferably from 90:10 to 65:35. The core portion has a mean particle size of from about 10 to 500 nm, preferably from 10 to 200 nm, and most preferably from 20 to 100 nm as measured, for example, by electron microscopy. The weight ratio of hydrophilic binder to polymer latex particles is from 95:5 to 10:90, more preferably from 95:5 to 30:70, and most preferably from 90:10 to 50:50 on a dry basis.

The coating composition of the present invention is useful for various applications. They can be used as interlayers, overcoat layers, receiving layers, emulsion layers, hydrophilic backing pelloid layers, and the like. When used as such, the coating composition of the present invention is particularly advantageous. The coating solution from which the hydrophilic layer is formed is unique in terms of its colloidal and mechanical shear stability. In particular, when the coating composition of the present invention is used in a surface protective layer, such as, the outermost protective layer, it provides the photographic elements excellent scratch, abrasion, and ferrotyping resistances. The coating composition of the present invention may be included in layers containing color components, silver halide antioxidants, reducing agents, UV absorbers, light protective agents and the like.

The core/shell polymer particles are in general prepared by the so-called sequential emulsion polymerization process (see, for example, Padget, J. C. in *Journal of Coating Technology*, Vol. 66, No. 839, pages 89 to 105, 1994), in which the latex core is made from a suitable monomer or a monomer mixture in a first stage and the hydrophilic shell on the core particles is prepared in a second stage by adding a comonomer mixture containing a portion of monomers having a carboxylic group. The core and shell portions of the particles can differ in their chemical compositions depending on the monomers used. The interface between the core and the shell can be sharp or diffuse.

In one of the preferred embodiments, the core/shell polymer particles are composed of a core portion which is crosslinked by using about 0.1 to 20 parts by weight of crosslinking agents and a shell portion which is grafted to the core portion by covalent bonding. In this process, the core portion is made with the use of di/trifunctional and grafting comonomers, and the shell portion is made by conducting the polymerization in a monomer starved manner so that the monomer swelling of the core particles is limited. The use of grafting comonomers in the core ensures the formation of sufficient covalent bonds between shell and crosslinked core polymers.

The core/shell particles of the present invention can also be prepared by an inverted core/shell polymerization process, in which the shell portion is prepared first, followed by polymerization of the core monomer in the presence of the shell materials.

Ethylenically unsaturated monomers which may be used in the core portion of the polymer particles of the present invention may include acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, and methacrylamide. Other monomers which may be used, either alone or in admixture with these acrylic monomers, include vinyl acetate, vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene-malonates, isoprene, and butadiene.

Preferred crosslinking and grafting comonomers which may be used, in order to effect crosslinking the core portion of the polymer particles and grafting the shell portion to the core portion, are monomers which are polyfunctional with respect to the polymerization reaction, including esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, dienes such as butadiene and isoprene, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

The core portion of the core/shell particles in the present invention can be made in the presence of a certain amount of pre-polymers, or functionalized oligomers, or macromonomers, which may include, for example, functionalized organosiloxanes prepared by reactions between organohydrosiloxane and multifunctional unsaturated monomers, fluorine-containing prepolymers, polyester urethanes, polyether urethanes, polyacrylourethanes, and the like.

The core portion of the core/shell particles in the present invention can be rubbery or glassy at room temperature, that is, the glass transition temperature of the core portion can be higher or lower than room temperature. The core portion can contain one phase or two or more incompatible phases. The incompatibility may be determined in various ways known in the art. The use of scanning electron microscopy using staining techniques to emphasize the differences between the appearance of the phases, for example, is such a technique.

The shell portion of the core/shell particles of the present invention comprise a monomer having a carboxylic acid group. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrenecarboxylic acid. Acrylic acid and methacrylic acid are preferred monomers. Suitable ethylenically unsaturated monomers which can be used together with the above carboxylic acid group containing monomers to form the shell portion of the core/shell polymer particle of the present invention include alkyl esters of acrylic monomers, such as acrylic acid or methacrylic acid, which include methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, acrylamide and methacrylamide, vinyl acetate, vinyl propionate, vinylidene chloride, vinyl chloride, and vinyl aromatic compounds such as styrene, t-butyl styrene, ethyl vinyl benzene, vinyl toluene, dialkyl maleates, dialkyl itaconates, dialkyl methylene-malonates, and the like.

The shell portion of the particles in the present invention may include reactive functional groups capable of forming covalent bonds with the hydrophilic binder by intermolecular crosslinking or by crosslinking reaction with a crosslinking agent. Suitable reactive functional groups include: carbodiimide, epoxide, aziridine, vinyl sulfone, sulfinic acid, active methylene, and the like.

The hydrophilic binder to be used with the core/shell polymer particles is not limited at all, and may include naturally occurring substances such as gelatin, other proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, homopolymer or copolymers containing styrene sulfonic acid, and the like. Gelatin is the most preferred hydrophilic binder.

Gelatin can be used together with other water-soluble polymers as hydrophilic binders in the practice of the present invention. Suitable water-soluble polymers include both synthetic and natural water-soluble polymers. Synthetic water-soluble polymers may contain a nonionic group, an anionic group, or a nonionic group and an anionic group in the molecular structure. The nonionic group may be, for example, an ether group, an ethylene oxide group, an amide group, or a hydroxyl group. The anionic group may be, for example, a sulfonic acid group or the salt thereof, a carboxylic acid group or the salt thereof, or a phosphoric acid group or the salt thereof. The natural water-soluble polymer may include a nonionic group, an anionic group, or a nonionic group and an anionic group in the molecular structure. The water-soluble polymers may be incorporated into the photographic materials of the present invention in an amount of at least 0.1 weight percent, preferably from 0.5 to 50 weight percent, and most preferably from 1 to 30 weight percent based on the amount of the whole coated amount of gelatin in the layer containing the core/shell polymer particles of the present invention.

The coating composition in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with functional groups present on the core/shell polymer particle, and/or the hydrophilic binder present in the coating composition.

Matte particles well known in the art may also be used in the coating composition of the invention. Such matting agents have been described in *Research Disclosure* No. 308, published Dec. 1989, pages 1008 to 1009. When polymer matte particles are employed, the polymer may contain reactive functional groups capable of forming covalent bonds with the binder polymer by intermolecular crosslinking or by reaction with a crosslinking agent in order to promote adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

The coating composition of the present invention may also include lubricants or combinations of lubricants to reduce sliding friction of the photographic elements in accordance with the invention. Typical lubricants include (1) silicone based materials disclosed, for example, in U.S. Pat. Nos. 3,489,567; 3,080,317; 3,042,522; 4,004,927 and 4,047,958; and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222 and 4,427,964; in British Patent Nos. 1,263,722; 1,198,387; 1,430,997; 1,466,304; 1,320,757; 1,320,565 and 1,320,756; and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly (tetrafluoroethlyene), poly(trifluorochloroethylene), poly (vinylidene fluoride, poly(trifluorochloroethylene-co-vinyl chloride), poly(meth)acrylates or poly(meth)acrylamides containing perfluoroalkyl side groups, and the like. Lubricants useful in the present invention are described in further detail in *Research Disclosure* No.308, published Dec. 1989, page 1006.

The protective layer useful in the practice of the invention may optionally contain surface active agents, antistatic agents, charge control agents, thickeners, silver halide particles, colloidal inorganic particles, magnetic recording particles, and various other additives.

The coating composition of the invention can be applied by any of a number of well-known techniques, such as dip coating, rod coating, blade coating, air knife coating, gravure coating and reverse roll coating, extrusion coating, slide coating, curtain coating, and the like. The core/shell polymer particles and the binder are mixed together in an aqueous medium to form a coating composition. After coating, the layer is generally dried by simple evaporation, which may be accelerated by known techniques such as convection heating. Known coating and drying methods are described in further detail in *Research Disclosure* No. 308, Published Dec. 1989, pages 1007 to 1008.

To form a coating solution useful for the practice of the present invention, the core/shell polymer latex particles are preferably added to a solution containing a hydrophilic binder under mechanical agitation. The pH value needs to be adjusted properly for both the core/shell latex and the solution containing the hydrophilic binder to ensure very good dispersion and mixing. The core/shell polymer particles can be neutralized. The neutralization ratio preferably used may vary in accordance with the type and amount of hydrophobic comonomer in the shell and the structure of the repeating unit having a carboxylic acid group. Basically, the neutralization may be set within a range where the core/shell polymer particles are compatible with the hydrophilic binder in the coating solution.

The present invention is also directed to a single-use camera having incorporated therein a photographic element as described above. Single-use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur.

Single-use cameras and their methods of manufacture and use are described in U.S. Pat. Nos. 4,801,957; 4,901,097; 4,866,459; 4,849,325; 4,751,536; 4,827,298; European Patent Applications 0 460 400; 0 533 785; 0 537 908; and 0 578 225, all of which are incorporated herein by reference.

The photographic processing steps to which the raw film may be subjected may include, but are not limited to the following:

1) color developing→bleach-fixing→washing/stabilizing;
2) color developing→bleaching→fixing→washing/stabilizing;
3) color developing→bleaching→bleach—fixing→washing/stabilizing;
4) color developing→stopping→washing→bleaching→washing→fixing→washing/stabilizing;
5) color developing→bleach-fixing→fixing→washing/stabilizing;
6) color developing→bleaching→bleach—fixing→fixing→washing/stabilizing;

The present invention is also directed to a single-use camera having incorporated therein a photographic element as described above. Single-use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur.

Single-use cameras and their methods of manufacture and use are described in U.S. Pat. Nos. 4,801,957; 4,901,097; 4,866,459; 4,849,325; 4,751,536; 4,827,298; European Patent Applications 0 460 400; 0 533 785; 0 537 908; and 0 578 225, all of which are incorporated herein by reference.

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention will now be described in detail with reference to examples; however, the present invention should not be limited to these examples.

The examples demonstrate the benefits of the core/shell synthetic copolymer latex particles of the present invention, and in particular show that the core/shell latex particles of the present invention have excellent miscibility with gelatin hydrophilic binder, and excellent stability against phase separation and flocculation when contained in a coating solution, and do not cause surface haze and/or generate spot defects which are harmful to the photographic properties of the element.

EXAMPLE 1

Preparation of Heterogeneous Copolymer Latex p-1:

A stirred reactor containing 728.3 g of deionized water and 3.2 g of sodium lauryl sulfate is heated to 80° C. and purged with $N_2$ for 1 hour. After addition of 0.75 g of potassium persulfate, an emulsion containing 3.2 g of sodium lauryl sulfate, 104.3 g of deionized water, 179.5 g of methyl methacrylate, 21 g of ethylene glycol dimethacrylate, 10.5 g of allyl methacrylate, and 0.25 g of potassium persulfate is slowly added over a period of 1 hour. The reaction is allowed to continue for an additional 2 hours. 0.35 g of benzoyl peroxide in 5 g of toluene was then added to the reactor. An emulsion containing 357.3 g of deionized water, 2.7 g of sodium lauryl sulfate, 81 g of methyl methacrylate, 9 g of methacrylic acid, and 0.15 g of benzoyl peroxide is added continuously for 1 hour. The reaction is allowed to continue for 3 more hours before the reactor is cooled down to room temperature. The latex prepared is filtered through an ultrafine filter (5 μm cut-off) to remove any coagulum. The particle so prepared contains about 70% core portion and 30% shell portion. The core contains about 85% of methyl methacrylate (MMA), 10% of ethylene glycol dimethacrylate(EGD), and 5% of allyl methacrylate (AM). The shell contains about 90% of methyl methacrylate and 10% of methacrylic acid (MA). The resultant polymer particles are designated as P-1.

Polymer particles P-2 to P-4 are prepared in a similar manner. Their compositions and sizes are listed in Table 1.

Preparation of Comparative Copolymer Latex P-5:

A stirred reactor containing 1012 g of deionized water and 3 g of Triton 770 surfactant (Rohm & Haas Co.) is heated to 80° C. and purged with $N_2$ for 1 hour. After addition of 1 g of potassium persulfate, and an emulsion containing 2.7 g of Triton 770 surfactant, 267 g of deionized water, 213.8 g of methyl methacrylate, 11.3 g of hydroxylethyl methacrylate (HEMA), and 0.5 g of potassium persulfate is slowly added over a period of 1 hour. The reaction is allowed to continue for 4 more hours before the reactor is cooled down to room temperature. The latex prepared is filtered through an ultrafine filter (5 μm cut-off) to remove any coagulum. The particle so prepared contains about 95% of methyl methacrylate and 5% of hydroxylethyl methacrylate. The resultant polymer particles are designated as P-5.

Other comparative polymer particles P-6 to P-10 are prepared in a similar manner. Their compositions and sizes are listed in Table 1.

TABLE 1

Polymer Latex Particles

| Particle | Diameter (nm) | Composition |
|---|---|---|
| P-1 | 38.6 | Core/Shell: 70/30<br>Core: MMA:EGD:AM = 85:10:5<br>Shell: MMA:MA = 90:10 |
| P-2 | 35.7 | Core/Shell: 70/30<br>Core: MMA:EGD:AM = 85:10:5<br>Shell: MMA:MA = 80:20 |
| P-3 | 89.4 | Core/Shell: 70/30<br>Core: MMA:EGD:AM = 85:10:5<br>Shell: MMA:MA = 70:30 |
| P-4 | 60.4 | Core/Shell: 70/30<br>Core: MMA:EGD:AM = 85:10:5<br>Shell: MMA:MA = 65:35 |
| P-5 | 40.7 | MMA:HEMA = 95:5 |
| P-6 | 25.3 | MMA |
| P-7 | 48.5 | MMA:AMPS = 95:5 |
| P-8 | 27.9 | MMA:MA = 97:3 |
| P-9 | 48.2 | EA:MA = 95:5 |
| P-10 | 36.8 | MMA:MAM = 95:5 |

EA: ethyl acrylate;
AMPS: acrylamido-2-methylpropane sulfonic acid, sodium salt;
MAM: methacylamide.

EXAMPLES 2 TO 6

Coating Solution Quality:

Coating solution quality is tested as follows: Solutions are made at 400° C. at 6% lime-processed gelatin and 6% latex polymer particles. The latex is added to the gelatin solution slowly under mechanical agitation. The quality of the resultant solutions is evaluated by measuring their turbidity at 600 nm. When the latex polymer particles are compatible with gelatin, the solution turbidity and therefore light absorbance at 600 nm should remain low. Table 2 shows the results.

TABLE 2

Coating Solution Quality

| Solutions | Latex Polymer | Absorbance at 600 nm |
|---|---|---|
| Example 2 (Comparative) | P-6 | 0.3 |
| Example 3 (Comparative) | P-8 | 0.25 |
| Example 4 (Invention) | P-1 | 0.04 |
| Example 5 (Invention) | P-2 | 0.06 |
| Example 6 (Invention) | P-4 | 0.08 |

Table 2 demonstrates that the latex polymer particles of the present invention have excellent compatibility with gelatin. Comparative Example 3 contains poly (methyl methacrylate-co-methacrylic acid) latex particles. The particles contain about 3 weight percent of methacrylic acid. The methacrylic acid is evenly distributed across the particle according to the method of preparation. The latex particles have poor compatibility with gelatin. On the other hand, Invention Example 4 contains latex particles of the present invention. The particles also contain about 3 weight percent of methacrylic acid, which is concentrated only in the shell. The latex particles have excellent compatibility with gelatin.

EXAMPLES 7 TO 14

Coating Quality and Appearance:

A series of coatings are prepared by applying aqueous coating solutions containing lime-processed gelatin, latex polymer particles and bis (vinylsulfone) methane onto a polymethylene terephthalate) film support that has been subbed in sequence with a terpolymer latex (vinylidene chloride, methyl acrylate, and itaconic acid) layer and a gelatin layer. The coating is chill-set at 4.5° C. and dried first at 21° C. and then at 37.8°C. The resultant coatings have a dry weight of 10 g/m$^2$. The coating quality is evaluated by visual appearance and the results are shown in Table 3.

Evaluation of Coating Scratch Resistance:

A 305 mm by 35 mm film strip is laid flat in the bottom of a film developing tray containing 30° C. (100° F.) C-41 developer for a minimum of 5 minutes. A 380 μm sapphire tipped stylus is placed on a starting mark on the gelatin coating side of the film and moved along the film strip at a constant rate, using a lever device that increases the mass loading as the stylus is advanced across the submerged film strip. At the end of the stylus path the strip is examined for the point of rupture of the gelatin layer. Using a gauge that translates distance of stylus travel to mass load on the stylus, a determination is made as to the amount of mass (in grams) needed to cause a rupture with this stylus. A minimum of four film strips are tested on each sample, and the results are averaged and reported in Table 3.

TABLE 3

Coating Quality and Appearance

| Coating Examples | Composition | Appearance | Wet Scratch Resistance (gws) |
|---|---|---|---|
| Example 7 (Comparative) | Gelatin:P-8 = 70:30 | Hazy | — |
| Example 8 (Comparative) | Gelatin:P-6 = 70:30 | Hazy | — |
| Example 9 (Comparative) | Gelatin:P-5 = 70:30 | Hazy | — |
| Example 10 (Comparative) | Gelatin:P-9 = 70:30 | Haze | — |
| Example 11 (Comparative) | Gelatin:P-7 = 70:30 | Clear | 73 |
| Example 12 (Comparative) | Gelatin:P-10 = 70:30 | Clear | 80 |
| Example 13 (Invention) | Gelatin:P-1 = 70:30 | Clear | 106 |
| Example 14 (Invention) | Gelatin:P-4 = 70:30 | Clear | 107 |

As shown in Table 3, the coatings containing copolymer latex particles of present invention have excellent coating quality and scratch resistance. Comparative Example 11 contains a poly(methyl methacrylate-co-acrylamido-2-methylpropane sulfonic acid, sodium salt) latex particle. The use of sulfonic acid containing monomers in latex particles has been well known in the art to improve the latex stability and compatibility with gelatin. The comparative coating Example 11 shows good coating quality, however, the use of sulfonic acid containing monomers in latex particles has significantly reduced the coating scratch resistance.

EXAMPLES 15 TO 18

Photographic Elements:

A series of photographic elements are prepared as follows: A poly(ethylene naphthalate) support having an antihalation layer on one side and an antistatic layer overcoated with a transparent magnetic recording layer on the other side is coated on the antihalation layer with the following imaging forming layers in sequence.

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Cyan Dye-forming Layer: This layer comprises a red sensitive silver bromoiodide emulsion (3.3 mole percent iodide) (0.324 μm grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer: This layer comprises a blend of a red sensitive silver bromoiodide emulsion (3.3 mole percent iodide) (0.488 μm grain size) (0.816 g/m$^2$ silver) and a red sensitive, tabular grain, silver bromoiodide emulsion (4.5 mole percent iodide) (0.98 μm diameter by 0.11 μm thick) (0.215 g/m$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer: This layer comprises a red sensitive, tabular grain, silver bromoiodide emulsion (4.5 mole percent iodide) (1.10 μm diameter by 0.11 μm thick) (1.08 g/m$^2$ silver), compound CC-1 (0.161 g/m$^2$), IR-3 (0.038 g/m$^2$), IR-4 (0.038 g/m$^2$), CM- (0.032 g/m$^2$), S-2 (0.237 g/m$^2$), S-5 (0.038 g/m$^2$), and gelatin (1.35 g/m$^2$).

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer: This layer comprises a blend of a green sensitive, tabular grain, silver bromoiodide emulsion (1.5 mole percent iodide) (0.7 μm diameter by 0.112 μm thick) (0.258 g/m$^2$ Ag), and a green sensitive, tabular grain, silver bromoiodide emulsion (1.3 mole percent iodide) (0.54 μm diameter by 0.086 μm thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer: This layer comprises a green sensitive, tabular grain, silver bromoiodide emulsion (4.5 mole percent iodide) (0.61 μm diameter by 0.12 μm thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer: This layer comprises a green sensitive, tabular grain, silver bromoiodide emulsion (4.5 mole percent iodide) (0.98 μm diameter by 0.113 μm thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$)

Yellow Filter Layer: This layer comprises 2,5-di-t-octyl-1,4-dihydroxy benzene (0.075 g/m$^2$), YD-2 (0.108 g/m$^2$), Irganox 1076 sold by Ciba Geigy (0.01 g /m$^2$), S-2 (0.121 g/m$^2$) and gelatin (0.861 g/m$^2$).

Slow Yellow Dye-forming Layer: This layer comprises a blend of a blue sensitive, tabular grain, silver bromoiodide emulsion (4.5 mole percent iodide) (1.4 μm diameter by 0.131 μm thick) (0.161 g/m$^2$ Ag), a blue sensitive, tabular grain, silver bromoiodide emulsion (1.5 mole percent iodide) (0.85 μm diameter by 0.131 μm thick) (0.0.108 g/m$^2$ Ag), and a blue sensitive, tabular grain, silver bromoiodide emulsion (1.3 mole percent iodide) (0.54 μm diameter by 0.086 μm thick) (0.161 g/m$^2$ Ag), compound Y-1 (0.915 g/m$^2$), IR-1 (0.032 g/m$^2$), B-1 (0.0065 g/m$^2$), S-1(0.489 g/m$^2$), S-3 (0.0084 g/m$^2$), and gelatin (1.668 g/m$^2$).

Fast Yellow Dye-forming Layer: This layer comprises a blue sensitive, tabular grain, silver bromoiodide emulsion (4.5 mole percent iodide) (2.3 μm diameter by 0.128 μm thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$). UV Protective Layer: This layer comprises compound UV-1 (0.111 g/m2), UV-2 (0.111 g/m$^2$)S-4 (0.222 g/m$^2$), silver bromide Lippmann emulsion (0.215 g/m$^2$ Ag), and gelatin (0.7 g/m$^2$).

Protective Overcoat Layer: A protective overcoat layer containing gelatin binder and latex polymer particles listed in Table 4 is coated on the top of the UV layer and has the following composition:

TABLE 4

| Composition of the Protective Overcoat Layer | |
|---|---|
| Gelatin, lime processed | 888 mg/m$^2$ |
| Silicone lube, DC-200 (Dow Corning) | 40.1 mg/m$^2$ |
| Fluorad FC-134 (3M Co.) | 3.9 mg/m$^2$ |
| Aerosol OT (American Cyanamide) | 21.5 mg/m$^2$ |
| Surfactant Olin 10 G (Olin Corp.) | 27.2 mg/m$^2$ |
| Poly(methyl methacrylate) bead 1.5 μm | 53.8 mg/$^2$ |
| Latex polymer particle (Table 5) | 322.9 mg/m$^2$ |

Y1

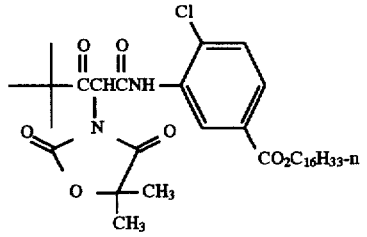

TABLE 4-continued
| Composition of the Protective Overcoat Layer |
|---|
| 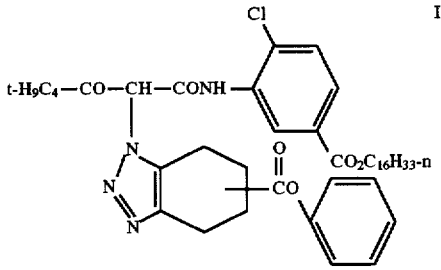 IR-1 |
| 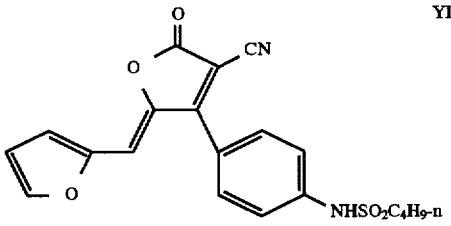 YD-2 |
| 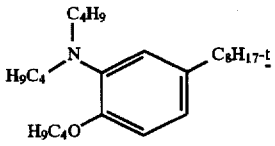 ST-1 |
| 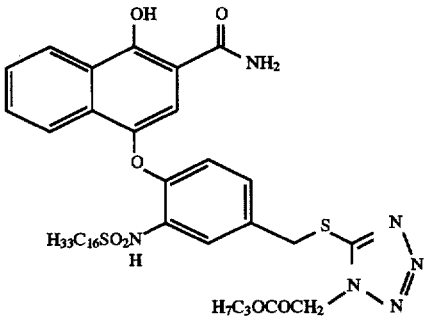 IR-2 |
| 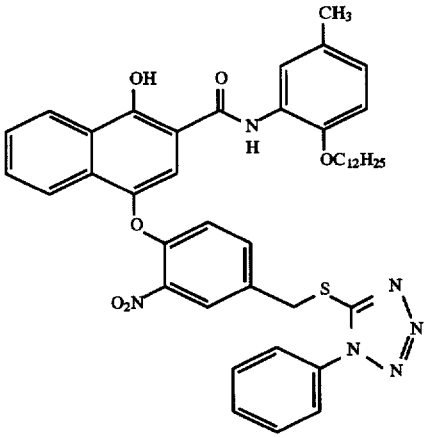 IR-3 |

TABLE 4-continued
| Composition of the Protective Overcoat Layer |
|---|
| 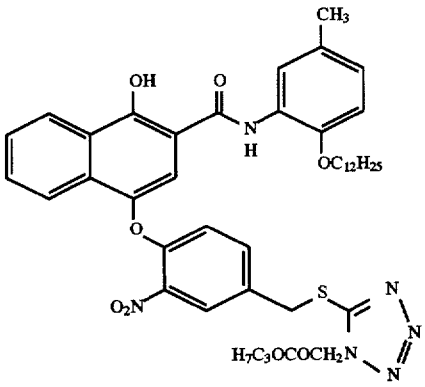 IR-4 |
| 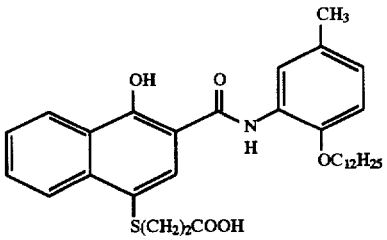 B-1 |
| 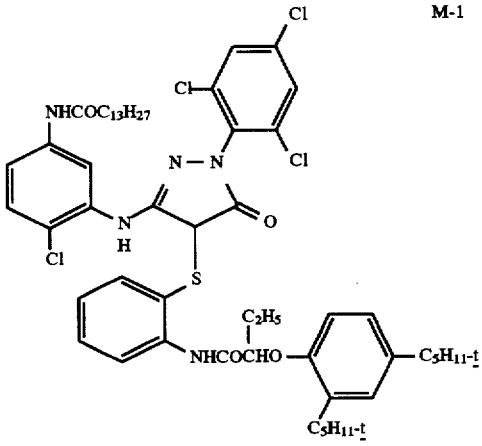 M-1 |

TABLE 4-continued
Composition of the Protective Overcoat Layer
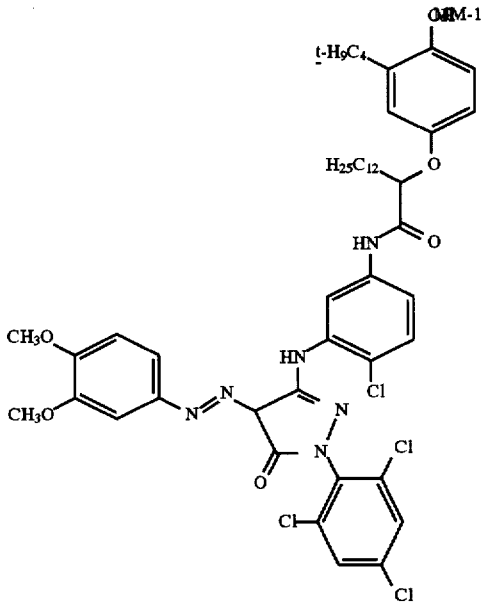
CM-1
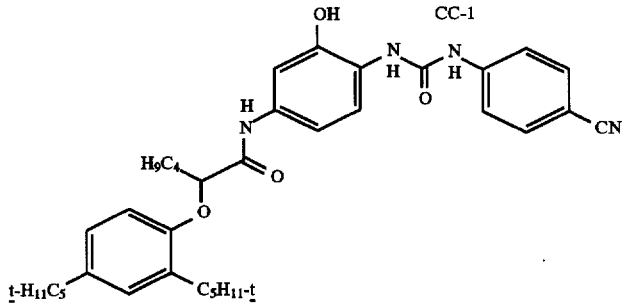
CC-1
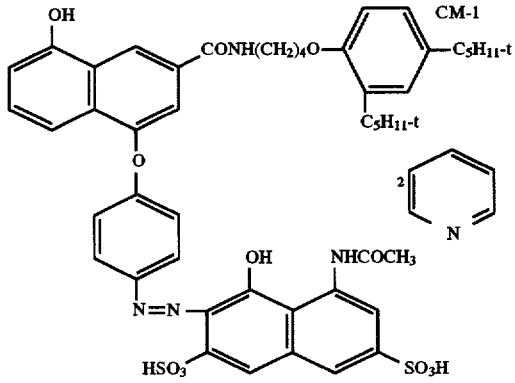
CM-1
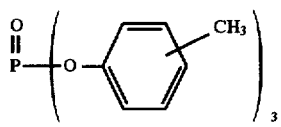
S-1
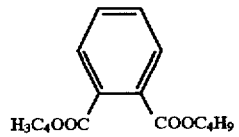
S-2
$C_{11}H_{23}CON(C_2H_5)_2$
S-3

TABLE 4-continued

| Composition of the Protective Overcoat Layer | |
|---|---|
| 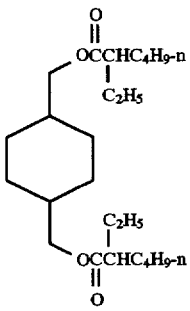 | S-4 |
| 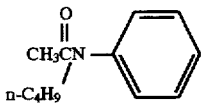 | S-5 |
| 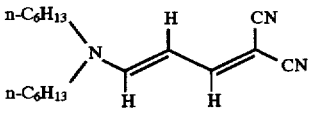 | UV-1 |
| 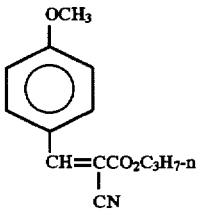 | UV-2 |

Evaluation of Surface Defects

The appearance of surface defects is evaluated by using scanning electron microscope. Surface defects larger than 5 μm are considered to be harmful to photographic properties and printable or visible in prints or projections. The results are reported in terms of "many" or "none". "Many" indicates that there are numerous surface defects caused by the presence of latex polymer particles. "None" indicates that no surface defects larger than 5 μm are present.

Evaluation of Ferrotyping Resistance

A group of six strips of the feature film (processed) are placed in a 80 percent relative humidity (RH) chamber for a minimum of 16 hours. The strips are stacked, sensitized side to unsensitized side and wrapped in foil, placed inside a moisture proof wrap, and sealed. The sealed package is then placed above a flat glass plate and under a brass bar of the same size with weight of 6.89 Kgs (15 lbs). The package, with the glass plate and brass bar is then placed in a 37.8° C. (100° F.) room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5 |
| B | 5 to <20 |
| C | 20 to <50 |
| D | 50 to 100 |

The testing results are reported in Table 5.

| Example | Latex Particle | Surface Defects | Ferrotyping Resistance |
|---|---|---|---|
| Example 15 (Comparative) | P-5 | Many | — |
| Example 16 (Comparative) | P-6 | Many | — |
| Example 17 (Comparative) | P-7 | None | D |
| Example 18 (Invention) | P-4 | None | B |

As shown in Table 5, the photographic element prepared in accordance with the present invention shows good ferrotyping protection and excellent surface quality. Comparative Examples 15 and 16 contain a poly(methyl methacrylate-co-methacrylic acid) latex and a poly(methyl methacrylate) latex, respectively. The use of such latex particles in the surface protective layer has resulted in many surface defects. Comparative Example 17 contains a poly(methyl methacrylate-co-acrylamido-2-methylpropane sulfonic acid, sodium salt) latex particle. Although the latex does not cause any surface defect, the resultant element has an inferior ferrotyping resistance.

What is claimed is:

1. A photographic element having a support, a light-sensitive layer and a protective overcoat layer, at least one layer comprising a hydrophilic colloid containing colloidal core-shell latex particles, the core being a hydrophobic polymer and the shell comprising greater than 10 and less than 90 mole percent of an ethylenically unsaturated monomer having a carboxylic acid group.

2. The photographic element of claim 1 wherein hydrophilic colloid is gelatin.

3. The photographic element of claim 1 wherein the core-shell weight ratio is from 95:5 to 30:70.

4. The photographic element of claim 1 wherein the core-shell weight ratio is from 90:10 to 50:50.

5. The photographic element of claim 1 wherein the core-shell weight ratio is from 90:10 to 65:35.

6. The photographic element of claim 1 wherein the core has a mean particle size of from 10 to 500 nm.

7. The photographic element of claim 1 wherein the core has a mean particle size of from 10 to 200 nm.

8. The photographic element of claim 1 wherein the core has a mean particle size of from 10 to 100 nm.

9. The photographic element of claim 1 wherein the weight ratio of hydrophilic binder to polymer latex particles is from 95:5 to 10:90.

10. The photographic element of claim 1 wherein the weight ratio of hydrophilic binder to polymer latex particles is from 95:5 to 30:70.

11. The photographic element of claim 1 wherein the weight ratio of hydrophilic binder to polymer latex particles is from 90:10 to 50:50.

12. The photographic element of claim 1 wherein the ethylenically unsaturated monomer having a carboxylic acid group is acrylic acid or methacrylic acid.

* * * * *